US011728566B2

(12) United States Patent
Hu et al.

(10) Patent No.: US 11,728,566 B2
(45) Date of Patent: Aug. 15, 2023

(54) ELECTRONIC DEVICES WITH PASSIVE RADIO-FREQUENCY POWER DISTRIBUTION CIRCUITRY

(71) Applicant: Apple Inc., Cupertino, CA (US)

(72) Inventors: Song Hu, San Jose, CA (US); Sohrab Emami-Neyestanak, Pasadena, CA (US)

(73) Assignee: Apple Inc.

( * ) Notice: Subject to any disclaimer, the term of this patent is extended or adjusted under 35 U.S.C. 154(b) by 0 days.

(21) Appl. No.: 17/940,969

(22) Filed: Sep. 8, 2022

(65) Prior Publication Data

US 2023/0006343 A1 Jan. 5, 2023

Related U.S. Application Data

(63) Continuation of application No. 17/014,814, filed on Sep. 8, 2020, now Pat. No. 11,581,633.

(51) Int. Cl.

| | |
|---|---|
| ***H01Q 1/38*** | (2006.01) |
| ***H01Q 7/00*** | (2006.01) |
| ***H01Q 3/28*** | (2006.01) |
| ***H01Q 3/36*** | (2006.01) |

(52) U.S. Cl.

CPC ..... *H01Q 1/38* (2013.01); *H01Q 3/28* (2013.01); *H01Q 3/36* (2013.01); *H01Q 7/00* (2013.01)

(58) Field of Classification Search

CPC .. H01Q 1/38; H01Q 3/28; H01Q 3/36; H01Q 7/00

See application file for complete search history.

(56) References Cited

U.S. PATENT DOCUMENTS

| | | | | |
|---|---|---|---|---|
| 9,413,414 | B2 | 8/2016 | Knox | |
| 9,577,683 | B2 | 2/2017 | Rudell et al. | |
| 9,641,156 | B1 | 5/2017 | Kang et al. | |
| 9,837,976 | B2 | 12/2017 | Kato et al. | |
| 2007/0228506 | A1 | 10/2007 | Min et al. | |
| 2018/0314349 | A1 | 11/2018 | Jiang et al. | |
| 2019/0378640 | A1 * | 12/2019 | Cheng | H01F 27/40 |

FOREIGN PATENT DOCUMENTS

| | | | |
|---|---|---|---|
| CN | 103141031 | A | 6/2013 |
| WO | 2019172283 | A1 | 9/2019 |
| WO | 2020053141 | A1 | 3/2020 |

* cited by examiner

*Primary Examiner* — Andrea Lindgren Baltzell

(74) *Attorney, Agent, or Firm* — Treyz Law Group, P.C.; Michael H. Lyons

(57) ABSTRACT

An electronic device may include a transceiver, first and second antennas, and a passive radio-frequency power distribution circuit. The distribution circuit may have a first port coupled to the transceiver, a second port coupled to the first antenna, and a third port coupled to the third antenna. The distribution circuit may include a transformer coupled between the ports. The transformer may have at least two intertwined inductors formed from conductive traces on a dielectric substrate. The intertwined inductors may be concentric about a common point. The intertwined inductors may extend from the common point to the second and third ports. The intertwined inductors may have a coil or spiral shape and may wind around the common point at least once. Intertwining the inductors may serve to minimize the lateral footprint of the distribution circuit in the device.

20 Claims, 8 Drawing Sheets

ELECTRONIC DEVICES WITH PASSIVE RADIO-FREQUENCY POWER DISTRIBUTION CIRCUITRY

This application is a continuation of U.S. patent application Ser. No. 17/014,814, filed Sep. 8, 2020, which is hereby incorporated by reference herein in its entirety.

FIELD

This disclosure relates generally to electronic devices and, more particularly, to electronic devices with wireless communications circuitry.

BACKGROUND

Electronic devices are often provided with wireless communications capabilities. An electronic device with wireless communications capabilities has wireless communications circuitry with radio-frequency components that include one or more antennas. Wireless transceiver circuitry in the wireless communications circuitry uses the antennas to transmit and receive radio-frequency signals.

It can be challenging to form satisfactory radio-frequency wireless communications circuitry for an electronic device. If care is not taken, the radio-frequency components in the wireless communications circuitry can occupy an excessive amount of space and can exhibit unsatisfactory levels of radio-frequency performance.

SUMMARY

An electronic device may include wireless circuitry for performing wireless communications. The wireless circuitry may include a transceiver, at least first and second antennas, and a passive radio-frequency power distribution circuit such as a Wilkinson power splitter/combiner. The distribution circuit may have at least a first port coupled to the transceiver, a second port coupled to the first antenna, and a third port coupled to the second antenna. The second and third ports may be coupled to the first and second antennas through respective phase and magnitude controllers and/or other passive radio-frequency power distribution circuits. The distribution circuit may include a transformer coupled between the ports. The transformer may have at least two intertwined inductors formed from conductive traces on a dielectric substrate. The intertwined inductors may be concentric about a common point. The intertwined inductors may extend from the common point to the second and third ports. The intertwined inductors may have a coil or spiral shape and may wind around the common point at least once. Intertwining the inductors may serve to minimize the lateral footprint of the distribution circuit in the device.

An aspect of the disclosure provides an electronic device. The electronic device can have a dielectric substrate. The electronic device can have a passive radio-frequency power distribution circuit. The passive radio-frequency power distribution circuit can have a first port, a second port, a third port, and a transformer. The transformer can couple the first port to the second and third ports. The transformer can include a first inductor coupled between the first and second ports. The transformer can include a second inductor coupled between the first and third ports. The second inductor can be intertwined with the first inductor on the dielectric substrate.

An aspect of the disclosure provides a passive radio-frequency power splitter. The passive radio-frequency power splitter can distribute power from an input port onto first and second output ports. The passive radio-frequency power splitter can have a dielectric substrate. The passive radio-frequency power splitter can have first conductive traces on the dielectric substrate. The first conductive traces can extend from a feed point to the first output port. The first conductive traces can have a coil shape that winds at least once around the feed point. The passive radio-frequency power splitter can have second conductive traces on the dielectric substrate. The second conductive traces can extend from the feed point to the second output port. The second conductive traces can have a coil shape that winds at least once around the feed point. The passive radio-frequency power splitter can have a feed trace on the dielectric substrate. The feed trace can couple the input port to the feed point.

An aspect of the disclosure provides a passive radio-frequency power combiner. The passive radio-frequency power combiner can combine radio-frequency power from first and second input ports onto an output port. The passive radio-frequency power combiner can have a dielectric substrate. The passive radio-frequency power combiner can have first conductive traces on the dielectric substrate. The first conductive traces can extend from the first input port to a feed point. The first conductive traces can have a spiral shape that winds at least once around the feed point. The passive radio-frequency power combiner can have second conductive traces on the dielectric substrate. The second conductive traces can extend from the second input port to the feed point. The second conductive traces can have a spiral shape that winds at least once around the feed point. The passive radio-frequency power combiner can have a feed trace on the dielectric substrate. The feed trace can couple the feed point to the output port.

DETAILED DESCRIPTION

Figure 1:
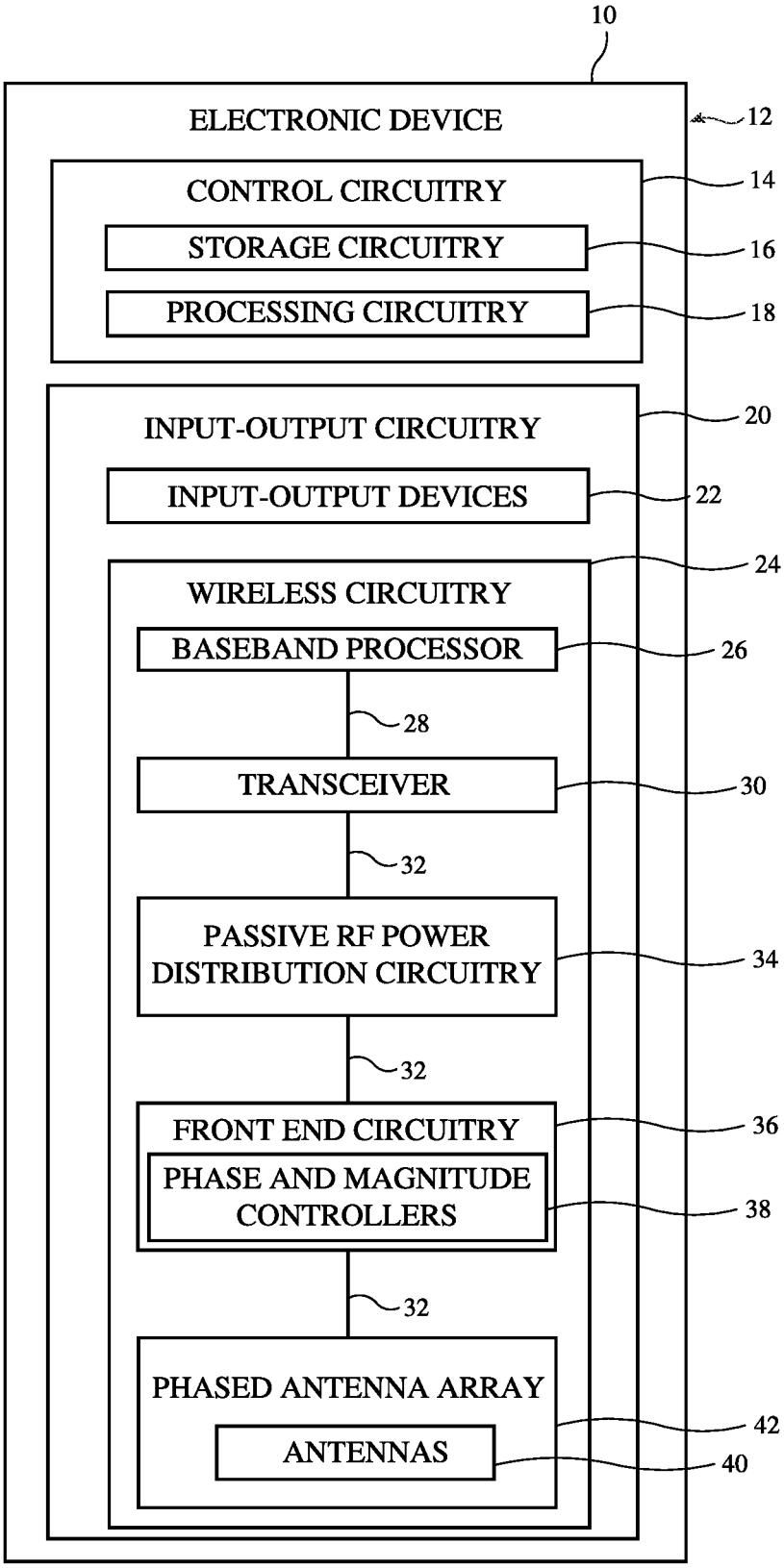
FIG. 1 is a schematic diagram of an illustrative electronic device having passive radio-frequency power distribution circuitry in accordance with some embodiments.

An electronic device such as electronic device 10 of FIG. 1 may be provided with wireless circuitry. The wireless circuitry may include a transceiver and at least first and second antennas. At least one passive radio-frequency power distribution circuit may be coupled between the transceiver and the first and second antennas. The distribution circuit may have a first port coupled to the transceiver, a second port coupled to the first antenna, and a third port coupled to the second antenna. The distribution circuit may include a transformer with at least two intertwined inductors. The intertwined inductors may be formed from conductive traces on a dielectric substrate. The conductive traces may have a coil shape, may be concentric, may extend from the feed point to the second and third ports, and may wind at least once around the feed point. In this way, the distribution circuit may occupy a minimal footprint on the dielectric substrate.

Electronic device 10 of FIG. 1 may be a computing device such as a laptop computer, a desktop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless internet-connected voice-controlled speaker, a home entertainment device, a remote control device, a gaming controller, a peripheral user input device, a wireless base station or access point, equipment that implements the functionality of two or more of these devices, or other electronic equipment.

As shown in the schematic diagram FIG. 1, device 10 may include components located on or within an electronic device housing such as housing 12. Housing 12, which may sometimes be referred to as a case, may be formed of plastic, glass, ceramics, fiber composites, metal (e.g., stainless steel, aluminum, metal alloys, etc.), other suitable materials, or a combination of these materials. In some situations, parts or all of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may include control circuitry 14. Control circuitry 14 may include storage such as storage circuitry 16. Storage circuitry 16 may include hard disk drive storage, nonvolatile memory (e.g., flash memory or other electrically-programmable-read-only memory configured to form a solid-state drive), volatile memory (e.g., static or dynamic random-access-memory), etc. Storage circuitry 16 may include storage that is integrated within device 10 and/or removable storage media.

Control circuitry 14 may include processing circuitry such as processing circuitry 18. Processing circuitry 18 may be used to control the operation of device 10. Processing circuitry 18 may include on one or more microprocessors, microcontrollers, digital signal processors, host processors, baseband processor integrated circuits, application specific integrated circuits, central processing units (CPUs), etc. Control circuitry 14 may be configured to perform operations in device 10 using hardware (e.g., dedicated hardware or circuitry), firmware, and/or software. Software code for performing operations in device 10 may be stored on storage circuitry 16 (e.g., storage circuitry 16 may include non-transitory (tangible) computer readable storage media that stores the software code). The software code may sometimes be referred to as program instructions, software, data, instructions, or code. Software code stored on storage circuitry 16 may be executed by processing circuitry 18.

Control circuitry 14 may be used to run software on device 10 such as satellite navigation applications, internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network (WLAN) protocols (e.g., IEEE 802.11 protocols—sometimes referred to as Wi-Fi®), protocols for other short-range wireless communications links such as the Bluetooth® protocol or other wireless personal area network (WPAN) protocols, IEEE 802.11ad protocols (e.g., ultra-wideband protocols), cellular telephone protocols (e.g., 3G protocols, 4G (LTE) protocols, 5G protocols, etc.), antenna diversity protocols, satellite navigation system protocols (e.g., global positioning system (GPS) protocols, global navigation satellite system (GLONASS) protocols, etc.), antenna-based spatial ranging protocols (e.g., radio detection and ranging (RADAR) protocols or other desired range detection protocols for signals conveyed at millimeter and centimeter wave frequencies), or any other desired communications protocols. Each communications protocol may be associated with a corresponding radio access technology (RAT) that specifies the physical connection methodology used in implementing the protocol.

Device 10 may include input-output circuitry 20. Input-output circuitry 20 may include input-output devices 22. Input-output devices 22 may be used to allow data to be supplied to device 10 and to allow data to be provided from device 10 to external devices. Input-output devices 22 may include user interface devices, data port devices, and other input-output components. For example, input-output devices 22 may include touch sensors, displays, light-emitting components such as displays without touch sensor capabilities, buttons (mechanical, capacitive, optical, etc.), scrolling wheels, touch pads, key pads, keyboards, microphones, cameras, buttons, speakers, status indicators, audio jacks and other audio port components, digital data port devices, motion sensors (accelerometers, gyroscopes, and/or compasses that detect motion), capacitance sensors, proximity sensors, magnetic sensors, force sensors (e.g., force sensors coupled to a display to detect pressure applied to the display), etc. In some configurations, keyboards, headphones, displays, pointing devices such as trackpads, mice, and joysticks, and other input-output devices may be coupled to device 10 using wired or wireless connections (e.g., some of input-output devices 22 may be peripherals that are coupled to a main processing unit or other portion of device 10 via a wired or wireless link).

Input-output circuitry 20 may include wireless circuitry 24 to support wireless communications. Wireless circuitry 24 (sometimes referred to herein as wireless communications circuitry 24) may include a baseband processor such as baseband processor 26, radio-frequency (RF) transceiver circuitry such as transceiver 30, radio-frequency front end circuitry such as front end circuitry 36, and one or more antennas 40. In one embodiment that is described herein as an example, wireless circuitry 24 may include multiple antennas 40 that are arranged into a phased antenna array 42. Baseband processor 26 may be coupled to transceiver 30 over baseband path 28. Transceiver 30 may be coupled to antennas 40 over at least one radio-frequency transmission line path 32. Front end circuitry 36 may be interposed on radio-frequency transmission line path 32 between transceiver 30 and antennas 40.

Wireless circuitry 24 may include a passive radio-frequency power distribution network such as passive radio-frequency power distribution circuitry 34. Passive radio-frequency power distribution circuitry 34 may be interposed on radio-frequency transmission line path 32 between antennas 40 and transceiver 30 (e.g., between front end circuitry 36 and transceiver 30). Passive radio-frequency power distribution circuitry 34 may include passive radio-frequency components that help to distribute radio-frequency power (e.g., transmitted and/or received radio-frequency signals) between transceiver 30 and antennas 40. As an example, passive radio-frequency power distribution circuitry 34 may include one or more stages of passive radio-frequency power distribution components. The passive radio-frequency power distribution components may include radio-frequency power splitter/combiners. The radio-frequency power splitter/combiners may include Wilkinson power splitter/combiners, for example.

In the example of FIG. 1, wireless circuitry 24 is illustrated as including only a single baseband processor 26, a single transceiver 30, and a single radio-frequency transmission line path 32 for the sake of clarity. In general, wireless circuitry 24 may include any desired number of baseband processors 26, any desired number of transceivers 30, and any desired number of antennas 40. Each baseband processor 26 may be coupled to one or more transceivers 30 over respective baseband paths 28. Each transceiver 30 may be coupled to one or more antennas 40 over respective radio-frequency transmission line paths 32. Each radio-frequency transmission line path 32 may have respective front end circuitry 36 and passive radio-frequency power distribution circuitry 34 interposed thereon. If desired, front end circuitry 36 and/or passive radio-frequency power distribution circuitry 34 may be shared by multiple radio-frequency transmission line paths 32.

Radio-frequency transmission line path 32 may be coupled to antenna feeds on one or more antenna 40. Each antenna feed may, for example, include a positive antenna feed terminal and a ground antenna feed terminal. Radio-frequency transmission line path 32 may have a positive transmission line signal path that is coupled to the positive antenna feed terminal and may have a ground transmission line signal path that is coupled to the ground antenna feed terminal. This example is merely illustrative and, in general, antennas 40 may be fed using any desired antenna feeding scheme.

Radio-frequency transmission line path 32 may include transmission lines that are used to route radio-frequency antenna signals within device 10. Transmission lines in device 10 may include coaxial cables, microstrip transmission lines, stripline transmission lines, edge-coupled microstrip transmission lines, edge-coupled stripline transmission lines, transmission lines formed from combinations of transmission lines of these types, etc. Transmission lines in device 10 such as transmission lines in radio-frequency transmission line path 32 may be integrated into rigid and/or flexible printed circuit boards. In one embodiment, radio-frequency transmission line paths such as radio-frequency transmission line path 32 may also include transmission line conductors integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

In performing wireless transmission, baseband processor 26 may provide baseband signals to transceiver 30 over baseband path 28. Transceiver 30 may include circuitry for converting the baseband signals received from baseband processor 26 into corresponding radio-frequency signals. For example, transceiver 30 may include mixer circuitry for up-converting the baseband signals to radio-frequencies prior to transmission over antennas 40. Transceiver 30 may also include digital to analog converter (DAC) and/or analog to digital converter (ADC) circuitry for converting signals between digital and analog domains. Transceiver 30 may transmit the radio-frequency signals over antennas 40 via radio-frequency transmission line path 32, front end circuitry 36, and passive radio-frequency power distribution circuitry 34. Antennas 40 may transmit the radio-frequency signals to external wireless equipment by radiating the radio-frequency signals into free space.

In performing wireless reception, antennas 40 may receive radio-frequency signals from the external wireless equipment. The received radio-frequency signals may be conveyed to transceiver 30 via radio-frequency transmission line path 32, front end circuitry 36, and passive radio-frequency power distribution circuitry 34. Transceiver 30 may include circuitry for converting the received radio-frequency signals into corresponding baseband signals. For example, transceiver 30 may include mixer circuitry for down-converting the received radio-frequency signals to baseband frequencies prior to conveying the baseband signals to baseband processor 26 over baseband path 28.

Front end circuitry 36 may include radio-frequency front end components that operate on radio-frequency signals conveyed over radio-frequency transmission line path 32. If desired, the radio-frequency front end components may be formed within one or more radio-frequency front end modules (FEMs). Each FEM may include a common substrate such as a printed circuit board substrate for each of the radio-frequency front end components in the FEM. In these scenarios, passive radio-frequency power distribution circuitry 34 may be formed on the FEM or may be located external to the FEM. If desired, passive radio-frequency power distribution circuitry 34 may be formed as a part of transceiver 30 or may be located external to the transceiver. The radio-frequency front end components in front end circuitry 36 may include switching circuitry (e.g., one or more radio-frequency switches), radio-frequency filter circuitry (e.g., low pass filters, high pass filters, notch filters, band pass filters, multiplexing circuitry, duplexer circuitry, diplexer circuitry, triplexer circuitry, etc.), impedance matching circuitry (e.g., circuitry that helps to match the impedance of antennas 40 to the impedance of radio-frequency transmission line path 32), antenna tuning circuitry (e.g., networks of capacitors, resistors, inductors, and/or switches that adjust the frequency response of antennas 40), radio-frequency amplifier circuitry (e.g., power amplifier circuitry and/or low-noise amplifier circuitry), radio-frequency coupler circuitry, charge pump circuitry, power management circuitry, digital control and interface circuitry, and/or any other desired circuitry that operates on the radio-frequency signals transmitted and/or received by antennas 40.

While control circuitry 14 is shown separately from wireless circuitry 24 in the example of FIG. 1 for the sake of clarity, wireless circuitry 24 may include processing circuitry that forms a part of processing circuitry 18 and/or storage circuitry that forms a part of storage circuitry 16 of control circuitry 14 (e.g., portions of control circuitry 14 may be implemented on wireless circuitry 24). As an example, baseband processor 26 and/or portions of transceiver 30 (e.g., a host processor on transceiver 30) may form a part of control circuitry 14.

Transceiver 30 may include wireless local area network transceiver circuitry that handles WLAN communications bands (e.g., Wi-Fi® (IEEE 802.11) or other WLAN communications bands) such as a 2.4 GHz WLAN band (e.g., from 2400 to 2480 MHz), a 5 GHz WLAN band (e.g., from 5180 to 5825 MHz), a Wi-Fi® 6E band (e.g., from 5925-7125 MHz), and/or other Wi-Fi® bands (e.g., from 1875-5160 MHz), wireless personal area network transceiver circuitry that handles the 2.4 GHz Bluetooth® band or other WPAN communications bands, cellular telephone transceiver circuitry that handles cellular telephone bands (e.g., bands from about 600 MHz to about 5 GHz, 3G bands, 4G LTE bands, 5G New Radio Frequency Range 1 (FR1) bands below 10 GHz, 5G New Radio Frequency Range 2 (FR2) bands between 20 and 60 GHz, etc.), near-field communications (NFC) transceiver circuitry that handles near-field communications bands (e.g., at 13.56 MHz), satellite navigation receiver circuitry that handles satellite navigation bands (e.g., a GPS band from 1565 to 1610 MHz, a Global Navigation Satellite System (GLONASS) band, a BeiDou Navigation Satellite System (BDS) band, etc.), ultra-wideband (UWB) transceiver circuitry that handles communications using the IEEE 802.15.4 protocol and/or other ultra-wideband communications protocols, and/or any other desired radio-frequency transceiver circuitry for covering any other desired communications bands of interest. In scenarios where device 10 handles NFC communications bands, device 10 may form an NFC tag (e.g., a passive or active NFC tag having a smart leakage management engine as described herein), may include an NFC tag integrated into a larger device or structure, or may be a different type of device that handles NFC communications, as examples. Communications bands may sometimes be referred to herein as frequency bands or simply as "bands" and may span corresponding ranges of frequencies.

Antennas 40 may be formed using any desired antenna structures. For example, antennas 40 may include antennas with resonating elements that are formed from loop antenna structures, patch antenna structures, inverted-F antenna structures, slot antenna structures, planar inverted-F antenna structures, helical antenna structures, monopole antennas, dipoles, hybrids of these designs, etc. Parasitic elements may be included in antennas 40 to adjust antenna performance.

Filter circuitry, switching circuitry, impedance matching circuitry, and other circuitry may be interposed within radio-frequency transmission line path 32, may be incorporated into front end circuitry 36, and/or may be incorporated into antennas 40 (e.g., to support antenna tuning, to support operation in desired frequency bands, etc.). These components, sometimes referred to herein as antenna tuning components, may be adjusted (e.g., using control circuitry 14) to adjust the frequency response and wireless performance of antennas 40 over time.

In general, transceiver 30 may cover (handle) any suitable communications (frequency) bands of interest. The transceiver may convey radio-frequency signals using antennas 40 (e.g., antennas 40 may convey the radio-frequency signals for the transceiver circuitry). The term "convey radio-frequency signals" as used herein means the transmission and/or reception of the radio-frequency signals (e.g., for performing unidirectional and/or bidirectional wireless communications with external wireless communications equipment). Antennas 40 may transmit the radio-frequency signals by radiating the radio-frequency signals into free space (or to freespace through intervening device structures such as a dielectric cover layer). Antennas 40 may additionally or alternatively receive the radio-frequency signals from free space (e.g., through intervening devices structures such as a dielectric cover layer). The transmission and reception of radio-frequency signals by antennas 40 each involve the excitation or resonance of antenna currents on an antenna resonating element in the antenna by the radio-frequency signals within the frequency band(s) of operation of the antennas.

In one embodiment that is sometimes described herein as an example, multiple antennas 40 may be arranged in a phased antenna array such as phased antenna array 42. In this scenario, each antenna 40 may form a respective antenna element of phased antenna array 42. Phased antenna array 42 may also sometimes be referred to herein as a phased array antenna having antenna elements, where each antenna 40 forms a respective one of the antenna elements. Conveying radio-frequency signals using phased antenna array 42 may allow for greater peak signal gain relative to scenarios where individual antennas 40 are used to convey radio-frequency signals.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. In scenarios where millimeter or centimeter wave frequencies are used to convey radio-frequency signals, phased antenna array 42 may convey radio-frequency signals over short distances that travel over a line-of-sight path. To enhance signal reception for millimeter and centimeter wave communications, phased antenna arrays such as phased antenna array 42 may convey radio-frequency signals using beam steering techniques (e.g., schemes in which antenna signal phase and/or magnitude for each antenna in an array are adjusted to perform beam steering).

For example, each antenna 40 in phased antenna array 42 may be coupled to a corresponding phase and magnitude controller 38 in front end circuitry 36. Phase and magnitude controllers 38 may adjust the relative phases and/or magnitudes of the radio-frequency signals that are conveyed by each of the antennas 40 in phased antenna array 42. The wireless signals that are transmitted or received by phased antenna array 42 in a particular direction may collectively form a corresponding signal beam. The signal beam may exhibit a peak gain that is oriented in a particular pointing direction at a corresponding pointing angle (e.g., based on constructive and destructive interference from the combination of signals from each antenna in the phased antenna array). Control circuitry 14 may adjust phase and magnitude controllers 38 to change the direction of the signal beam over time (e.g., to allow device 10 to continue to communicate with external equipment even if the external equipment moves relative to device 10 over time). This example is merely illustrative and, in general, antennas 40 need not be arranged in a phased antenna array.

Passive radio-frequency power distribution circuitry 34 may be used to distribute radio-frequency power (e.g., radio-frequency signals) between transceiver 30 and antennas 40 via phase and magnitude controllers 38 (or between transceiver 30 and other front end components in front end circuitry 36 in scenarios were antennas 40 are not arranged in a phased antenna array). Passive radio-frequency power distribution circuitry 34 may, for example, allow a single port on transceiver 30 to provide radio-frequency signals to multiple antennas 40 in phased antenna array 42.

Figure 2:
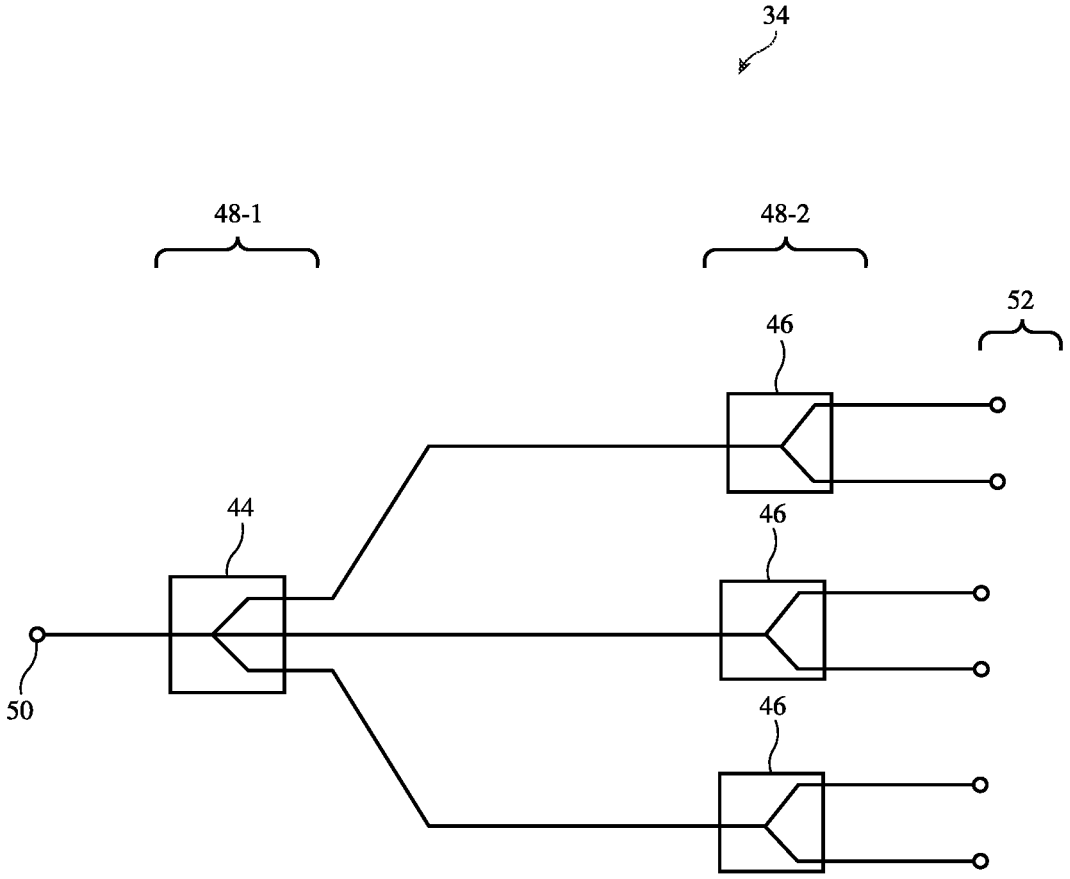
FIG. 2 is a circuit diagram of illustrative passive radio-frequency power distribution circuitry having stages of power splitter/combiners in accordance with some embodiments.

FIG. 2 is a circuit diagram of passive radio-frequency power distribution circuitry 34 in one example. As shown in FIG. 2, passive radio-frequency power distribution circuitry 34 may include one or more cascaded stages 48 of passive radio-frequency power distribution components. In the example of FIG. 2, passive radio-frequency power distribution circuitry 34 includes a first stage 48-1 and a second stage 48-2. Stage 48-1 may be coupled to upstream radio-frequency port 50 of passive radio-frequency power distribution circuitry 34. Stage 48-2 may be coupled between stage 48-1 and downstream radio-frequency ports 52 of passive radio-frequency power distribution circuitry 34.

Upstream radio-frequency port 50 may be coupled to transceiver 30 over a first portion of radio-frequency transmission line path 32 (FIG. 1). Each downstream radio-frequency port 52 may be coupled to a respective antenna 40 in phased antenna array 42 via a respective one of the phase and magnitude controllers 38 in front end circuitry 36 (FIG. 1). This is merely illustrative and, in general, downstream radio-frequency ports 52 may be coupled to any desired components in front end circuitry 36 and upstream radio-frequency port 50 may be coupled to any desired components in transceiver 30 or to a radio-frequency front end component in front end circuitry 36.

The passive radio-frequency power distribution components in stages 48 may include passive radio-frequency power splitter/combiners. The power splitter/combiners may include one or more four-port power splitter/combiners 44 (sometimes referred to herein as 1:3 power splitter/combiners 44) and/or may include one or more three-port power/splitter combiners 46 (sometimes referred to herein as 1:2 power splitter/combiners 46). In one embodiment that is sometimes described herein as an example, the power splitter/combiners in passive radio-frequency power distribution circuitry 34 are Wilkinson power splitter/combiners (e.g., 1:3 power splitter/combiners 44 may be 1:3 Wilkinson power splitter/combiners and 1:2 power splitter/combiners 46 may be 1:2 Wilkinson power splitter/combiners). In the example of FIG. 2, stage 48-1 includes one 1:3 power splitter/combiner 44 and stage 48-2 includes three 1:2 power splitter/combiners 46. This may allow passive radio-frequency power distribution circuitry 34 to distribute power between a single port of transceiver 30 and six antennas 40 in phased antenna array 42 (e.g., in scenarios where phased antenna array 42 of FIG. 1 includes six antennas 40).

In the example of FIG. 2, one 1:3 power splitter/combiner 44 in stage 48-1 may replace the use of two stages of 1:2 power splitter/combiners 46 coupled between stage 48-2 and upstream radio-frequency port 50. This may serve to minimize the area required to form passive radio-frequency power distribution circuitry 34, thereby freeing up more space for other components in device 10. This may also serve to minimize wasted power that would otherwise be incurred by a dummy load (e.g., in scenarios where three stages 48 of 1:2 power splitter/combiners are used).

This example is merely illustrative. In general, each stage 48 may include any desired number of 1:3 power splitter/combiners 44 and any desired number of 1:2 power splitter/combiners 46. Passive radio-frequency power distribution circuitry 34 may include any desired number of stages 48. Passive radio-frequency power distribution circuitry 34 may include any desired number of downstream radio-frequency ports 52 (e.g., a respective downstream radio-frequency port 52 for each antenna 40 in phased antenna array 42 of FIG. 1) and any desired number of upstream radio-frequency ports 50. If desired, passive radio-frequency power distribution circuitry 34 may include power splitter/combiners having more than four ports (e.g., 1:4 power splitter/combiners, 1:5 power splitter/combiners, 1:6 power splitter/combiners, etc.).

Passive radio-frequency power distribution circuitry 34 may be used to convey radio-frequency signals from upstream radio-frequency port 50 to downstream radio-frequency ports 52 (e.g., for transmission by phased antenna array 42) and/or may be used to convey radio-frequency signals from downstream radio-frequency ports 52 to upstream radio-frequency port 50 (e.g., radio-frequency signals received by phased antenna array 42 from external communications equipment). Because 1:3 power splitter/combiner 44 and 1:2 power splitter/combiners 46 are passive circuits, passive radio-frequency power distribution circuitry 34 may be used to equivalently convey radio-frequency signals in either direction between antennas 40 and transceiver 30.

In scenarios where passive radio-frequency power distribution circuitry 34 is used to convey radio-frequency signals from upstream radio-frequency port 50 to downstream radio-frequency ports 52 (e.g., in an uplink direction), each 1:3 power splitter/combiner 44 may serve as a 1:3 power splitter. Similarly, each 1:2 power splitter/combiner 46 may serve as a 1:2 power splitter (e.g., passive radio-frequency power distribution circuitry 34 may serve as a power splitter or divider that distributes radio-frequency power from upstream radio-frequency port 50 across each downstream radio-frequency port 52). In these scenarios where passive radio-frequency power distribution circuitry 34 is being used to transmit radio-frequency signals over antennas 40, the 1:3 power splitter/combiners 44 and the 1:2 power splitter/combiners 46 in passive radio-frequency power distribution circuitry 34 may sometimes be referred to as power splitters, radio-frequency power splitters, power dividers, radio-frequency power dividers, Wilkinson power dividers, or Wilkinson power splitters.

In scenarios where passive radio-frequency power distribution circuitry 34 is used to convey radio-frequency signals from downstream radio-frequency ports 52 to upstream radio-frequency port 50 (e.g., in a downlink direction), each 1:3 power splitter/combiner 44 may serve as a 1:3 power combiner. Similarly, each 1:2 power splitter/combiner 46 may serve as a 1:2 power combiner (e.g., passive radio-frequency power distribution circuitry 34 may serve as a power combiner that combines radio-frequency power from downstream radio-frequency ports 52 onto upstream radio-frequency port 50). In these scenarios where passive radio-frequency power distribution circuitry 34 is being used to receive radio-frequency signals from antennas 40, the 1:3 power splitter/combiners 44 and the 1:2 power splitter/combiners 46 in passive radio-frequency power distribution circuitry 34 may sometimes be referred to as power combiners, radio-frequency power combiners, or Wilkinson power combiners.

1:3 power splitter/combiners 44 and the 1:2 power splitter/combiners 46 may be dedicated power combiners in scenarios where passive radio-frequency power distribution circuitry 34 is used only to receive radio-frequency signals from antennas 40. 1:3 power splitter/combiners 44 and the 1:2 power splitter/combiners 46 may be dedicated power splitters in scenarios where passive radio-frequency power distribution circuitry 34 is used only to transmit radio-frequency signals over antennas 40. However, because 1:2 power splitter/combiners 46 and 1:3 power splitter/combiners 44 are passive components, 1:2 power splitter/combiners 46 and 1:3 power splitter/combiners 44 may serve as power splitters when passive radio-frequency power distribution circuitry 34 is transmitting radio-frequency signals over antennas 40 and may serve as power combiners when passive radio-frequency power distribution circuitry 34 is receiving radio-frequency signals from antennas 40. 1:3 power splitter/combiners 44 and the 1:2 power splitter/combiners 46 in passive radio-frequency power distribution circuitry 34 may sometimes be referred to collectively herein as power splitter/combiners, radio-frequency power splitter/combiners, radio-frequency power distribution circuits, passive radio-frequency power distribution circuits, passive radio-frequency power splitter/combiners, Wilkinson power splitter/combiners, Wilkinson circuits, or Wilkinson power distribution circuits.

Figure 3:
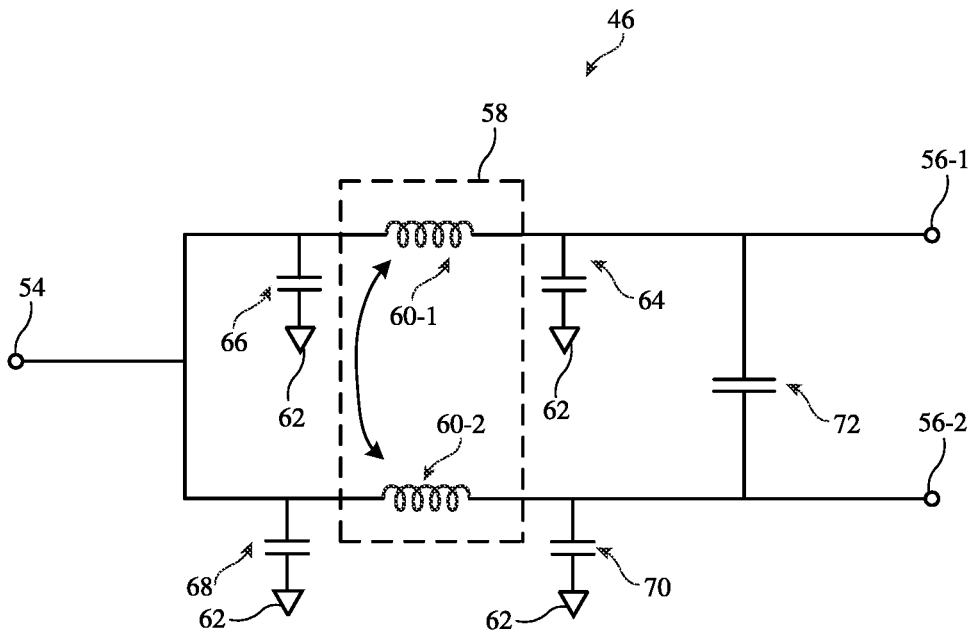
FIG. 3 is a circuit diagram of an illustrative 1:2 power splitter/combiner in accordance with some embodiments.

FIG. 3 is a circuit diagram of an exemplary 1:2 power splitter/combiner 46. As shown in FIG. 3, 1:2 power splitter/combiner 46 may have an upstream radio-frequency port such as upstream port 54 (sometimes referred to herein as upstream terminal 54). Upstream port 54 may be coupled to components in wireless circuitry 24 that are upstream from 1:2 power splitter/combiner 46. For example, upstream port 54 may be coupled to a downstream port on 1:3 power splitter/combiner 44 of FIG. 2, may be coupled to a downstream port on a different power splitter/combiner in passive radio-frequency power distribution circuitry 34, may be coupled to upstream radio-frequency port 50 of FIG. 2, etc.

1:2 power splitter/combiner 46 may also have two downstream radio-frequency ports such as downstream ports 56 (e.g., a first downstream port 56-1 and a second downstream port 56-2). Downstream ports 56 may sometimes be referred to herein as downstream terminals 56. Each downstream port 56 may be coupled to a respective component in wireless circuitry 24 that is downstream from 1:2 power splitter/combiner 46. For example, downstream port 56-1 may be coupled to a first antenna 40 in phased antenna array 42 (e.g., via a first phase and magnitude controller 38 of FIG. 1) whereas downstream port 56-2 is coupled to a second antenna 40 in phased antenna array 42 (e.g., via a second phase and magnitude controller 38 of FIG. 1). As another example, downstream ports 56-1 and 56-2 may be coupled to the upstream port of respective 1:2 power splitter/combiners 46, the upstream port of respective 1:3 power splitter/combiners 44, or the upstream port of any other desired power splitter/combiners in passive radio-frequency power distribution circuitry 34.

In scenarios where 1:2 power splitter/combiner 46 is being used to transmit radio-frequency signals over antennas 40 (e.g., where 1:2 power splitter/combiner 46 is a 1:2 power splitter), upstream port 54 forms an input port and downstream ports 56 form output ports of 1:2 power splitter/combiner 46. In scenarios where 1:2 power splitter/combiner 46 is being used to receive radio-frequency signals from antennas 40 (e.g., where 1:2 power splitter/combiner 46 is a 1:2 power combiner), upstream port 54 forms an output port and downstream ports 56 form input ports of 1:2 power splitter/combiner 46.

1:2 power splitter/combiner 46 may include a transformer such as transformer 58. Transformer 58 may be coupled between upstream port 54 and downstream ports 56. Transformer 58 may include a set of inductors 60 coupled in parallel between upstream port 54 and downstream ports 56. For example, as shown in FIG. 3, transformer 58 may include a first inductor 60-1 coupled between upstream port 54 and downstream port 56-1 and may include a second inductor 60-2 coupled between upstream port 54 and downstream port 56-2.

1:2 power splitter/combiner 46 may include a capacitor such as capacitor 72. Capacitor 72 may be coupled between downstream ports 56-1 and 56-2. 1:2 power splitter/combiner 46 may also include capacitors such as capacitors 64, 66, 68, and/or 70. Capacitor 66 may be coupled between upstream port 54 and reference potential 62 at the upstream side of inductor 60-1. Reference potential 62 may be a ground potential or another reference potential in device 10. Capacitor 64 may be coupled between downstream port 56-1 and reference potential 62 at the downstream side of inductor 60-1. Capacitor 70 may be coupled between downstream port 56-2 and reference potential 62 at the downstream side of inductor 60-2. Capacitor 68 may be coupled between upstream port 54 and reference potential 62 at the upstream side of inductor 60-2.

In one embodiment that is described herein as an example, capacitors 66, 68, 64, 70, and 72 are distributed capacitors that exhibit distributed capacitances between conductive traces in 1:2 power splitter/combiner 46. This is merely illustrative and, if desired, one or more of capacitors 66, 68, 64, 70, and 72 may be discrete capacitors (e.g., surface mount technology (SMT) capacitors). Transformer 58 and capacitors 66, 68, 64, 70, and 72 may serve to distribute radio-frequency power at upstream port 54 across downstream ports 56-1 and 56-2 (e.g., in scenarios where 1:2 power splitter/combiner 46 is transmitting radio-frequency signals over antennas 40) and/or to combine radio-frequency power at downstream ports 56-1 and 56-2 onto upstream port 54.

In some scenarios, inductors 60-1 and 60-2 in transformer 58 are formed from two laterally-separated inductive coils on an underlying substrate. However, forming inductors 60-1 and 60-2 from two laterally-separated inductive coils may cause transformer 58 to occupy an excessively large lateral footprint in device 10, thereby minimizing the amount of space in device 10 that can be used for other components. In order to minimize the lateral footprint of transformer 58, inductors 60-1 and 60-2 may be intertwined inductors (e.g., intertwined inductors concentric about a single point).

Figure 4:
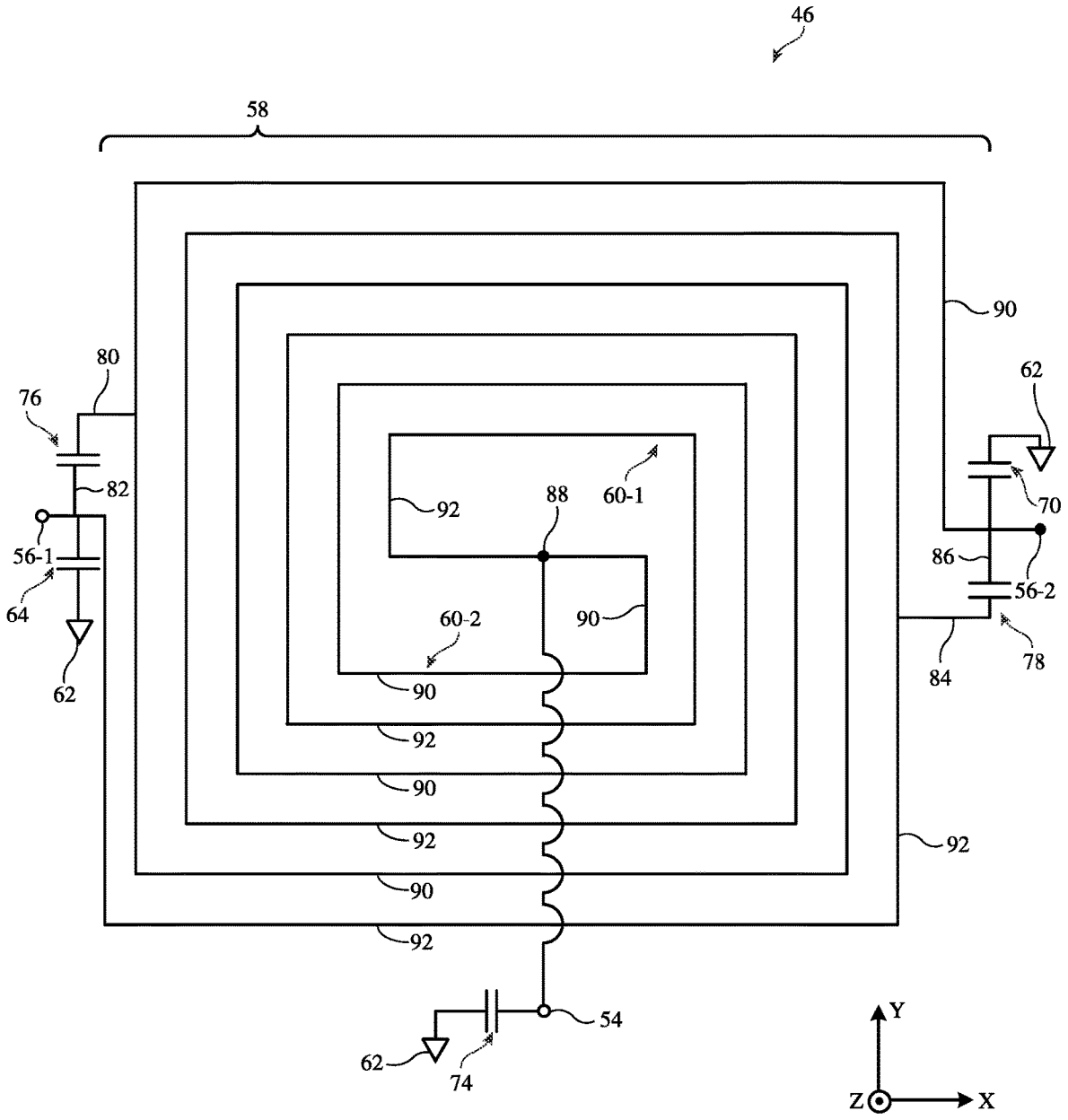
FIG. 4 is a diagram of an illustrative 1:2 power splitter/combiner having intertwined inductors in accordance with some embodiments.

FIG. 4 is a diagram showing how 1:2 power splitter/combiner 46 may include intertwined inductors 60-1 and 60-2. As shown in FIG. 4, upstream port 54 may be coupled to transformer 58 at feed point 88 (e.g., using a conductive feed trace on an underlying dielectric substrate). A capacitance such as capacitance 74 may be coupled between upstream port 54 and reference potential 62. Capacitance 74 may, for example, be the capacitance associated with capacitors 66 and 68 of FIG. 3.

Inductor 60-1 may be formed from conductive traces 92. Conductive traces 92 may have a planar spiral or coil shape and may wind (wrap) around feed point 88 (e.g., in a counter-clockwise direction or, as shown in the example of FIG. 4, in a clockwise direction about feed point 88). Conductive traces 92 and thus inductor 60-1 may terminate at downstream port 56-1. Coiling conductive traces 92 in this way may configure conductive traces 92 to exhibit a desired inductance between feed point 88 and downstream port 56-1 (e.g., the inductance of inductor 60-1).

Inductor 60-2 may be formed from conductive traces 90 (shown in bold in FIG. 4). Conductive traces 90 may have a planar spiral or coil shape and may wind (wrap) around feed point 88. Conductive traces 90 may wind around feed point 88 in the same direction as conductive traces 92 (e.g., conductive traces 90 may wind around feed point 88 in a clockwise direction about feed point 88). Conductive traces 90 and thus inductor 60-2 may terminate at downstream port 56-2. Coiling conductive traces 90 in this way may configure conductive traces 90 to exhibit a desired inductance between feed point 88 and downstream port 56-2 (e.g., the inductance of inductor 60-2).

As shown in FIG. 4, when configured in this way, conductive traces 92 and thus inductor 60-1 may be intertwined with conductive traces 90 and inductor 60-2 (e.g., on an underlying dielectric substrate). Each segment of conductive traces 92 except for the first and last half-turn around feed point 88 may be laterally interposed between two segments of conductive traces 90. Similarly, each segment of conductive traces 90 except for the first and last half-turn around feed point 88 may be laterally interposed between two segments of conductive traces 92. In other words, conductive traces 92 (inductor 60-1) and conductive traces 90 (inductor 60-2) may be arranged in a common centroid configuration in which the conductive traces and inductors are concentric about a common point or axis (e.g., about feed point 88 or an axis running through feed point 88 parallel to the Z-axis of FIG. 4). This may configure transformer 58 to exhibit the lateral footprint that is approximately the same as the lateral footprint of only a single one of inductors 60-1 or 60-2, rather than a lateral footprint that is greater than or equal to the lateral footprint of inductors 60-1 and 60-2 combined. This may serve to minimize the lateral footprint and thus the space consumed by transformer 58 in device 10.

In the example of FIG. 4, conductive traces 92 and 90 (inductors 60-1 and 60-2) each make three complete turns (e.g., 360-degree passes) around feed point 88 in winding from feed point 88 to downstream ports 56-1 and 56-2, respectively. This is merely illustrative. In other embodiments, conductive traces 92 and 90 may each make two complete turns around feed point 88, four complete turns around feed point 88, more than four complete turns around feed point 88, fewer than two complete turns around feed point 88, a non-integer number of turns around feed point 88, etc.

As shown in FIG. 4, capacitor 64 may be coupled between conductive traces 92 and reference potential 62 (e.g., at downstream port 56-1). Capacitor 70 may be coupled between conductive traces 90 and reference potential 62 (e.g., at downstream port 56-2). Conductive traces 92 may include segment 84. Conductive traces 90 may include segment 86. Segments 86 and 84 may form respective capacitor electrodes for capacitance 78. Conductive traces 92 may also include segment 82. Conductive traces 90 may also include segment 80. Segments 80 and 82 may form respective capacitor electrodes for capacitance 76. Capacitance 78 and capacitance 76 may collectively form capacitor 72 of FIG. 3, for example.

Figure 5:
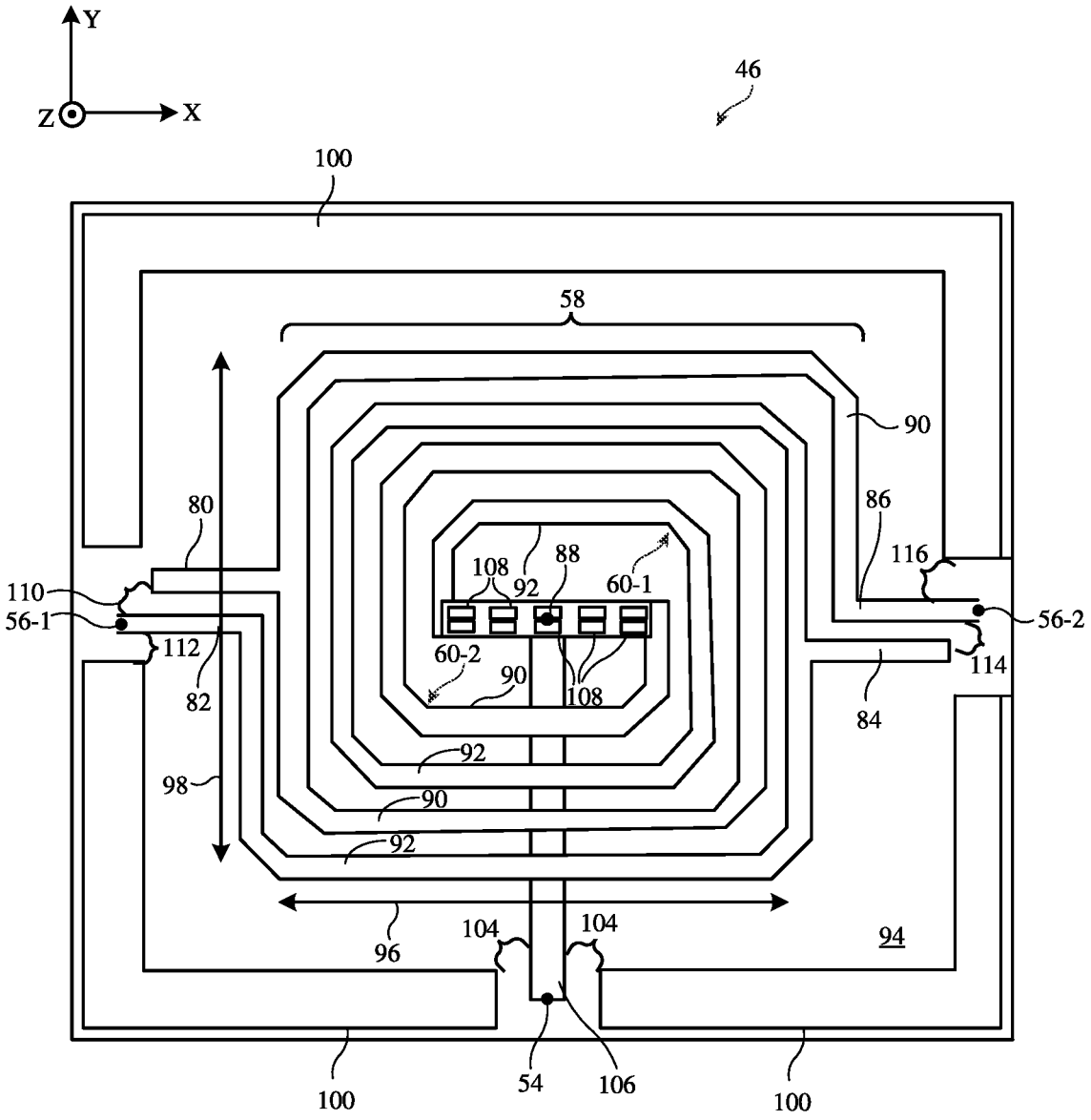
FIG. 5 is a layout diagram of an illustrative 1:2 power splitter/combiner having intertwined inductors in accordance with some embodiments.

FIG. 5 is a top-down layout diagram of 1:2 power splitter/combiner 46. As shown in FIG. 5, 1:2 power splitter/combiner 46 may be formed on a dielectric substrate such as dielectric substrate 94. Dielectric substrate 94 may, for example, include multiple vertically-stacked dielectric layers (e.g., dielectric layers that are stacked in the direction of the Z-axis of FIG. 5).

Upstream port 54 may be coupled to feed trace 106. Feed trace 106 may extend into the central portion (region) of transformer 58. Feed trace 106 may, for example, be patterned onto a first dielectric layer of dielectric substrate 94. Conductive traces 90 for inductor 60-2 and conductive traces 92 for inductor 60-1 may be patterned onto a second dielectric layer of dielectric substrate 94 (e.g., a dielectric layer that is layered over the first dielectric layer of dielectric substrate 94). One or more conductive through vias such as conductive vias 108 may couple feed trace 106 to conductive traces 92 and 90 (e.g., at and/or adjacent feed point 88). Conductive traces 90 and 92 may extend from opposing sides of feed point 88.

Conductive ground traces such as ground traces 100 may be patterned onto dielectric substrate 94. If desired, ground traces 100 may be patterned on both the first and second dielectric layers of dielectric substrate 94. In this example, conductive vias may couple the ground traces on each of the dielectric layers together. Ground traces 100 may be held at a reference potential (e.g., reference potential 62 of FIGS. 3 and 4). Feed trace 106 may be laterally separated from ground traces 100 by one or more gaps 104. The capacitance associated with gap(s) 104 may form capacitance 74 of FIG. 4 and the capacitance of capacitors 66 and 68 of FIG. 3, for example.

Conductive traces 92 and 90 may both be intertwined as the conductive traces spiral from feed point 88 outwards to downstream ports 56-1 and 56-2 (e.g., conductive traces 92 and 90 may be interspersed or interleaved as the conductive traces wind around feed point 88). This may configure inductors 60-1 and 60-2 and thus transformer 58 to exhibit a length 96 and a width 98. Length 96 and width 98 may define the lateral footprint of transformer 58. Length 96 may be equal to width 98 or may be different from width 98. As just one example, width 98 may be between 40-70 microns whereas length 96 is between 50-80 microns. The lateral footprint of transformer 58 may be similar to the lateral footprint of just one of inductors 60-1 or 60-2, thereby minimizing the overall footprint of 1:2 power splitter/combiner 46, despite the fact that 1:2 power splitter/combiner 46 includes two separate inductors that are coupled in parallel between upstream port 54 and downstream ports 56-1 and 56-2.

As shown in FIG. 5, at downstream port 56-1, segment 82 of conductive traces 92 may be separated from ground traces 100 by gap 112. Similarly, at downstream port 56-2, segment 86 of conductive traces 90 may be separated from ground traces 100 by gap 116. The capacitance associated with gap 112 may form capacitor 64 of FIGS. 3 and 4, for example. Similarly, the capacitance associated with gap 116 may form capacitor 70 of FIGS. 3 and 4.

Segment 80 of conductive traces 90 may extend parallel to segment 82 of conductive traces 92. Segment 82 may be separated from segment 80 by gap 110. Similarly, segment 84 of conductive traces 92 may extend parallel to segment 86 of conductive traces 90. Segment 84 may be separated from segment 86 by gap 114. The capacitance associated with gap 110 may form capacitance 76 of FIG. 4, for example. Similarly, the capacitance associated with gap 114 may form capacitance 70 of FIG. 4. In other words, the capacitance associated with gaps 110 and 114 may collectively form capacitor 72 of FIG. 3.

The example of FIG. 5 is merely illustrative. Conductive traces 90 and 92 may have other shapes concentric about feed point 88 if desired (e.g., conductive traces 90 and 92 may have a rectangular spiral shape as shown in FIG. 5, a circular spiral shape, an elliptical spiral shape, shapes with any desired number of straight and/or curved segments, combinations of these, etc.).

Figure 6:
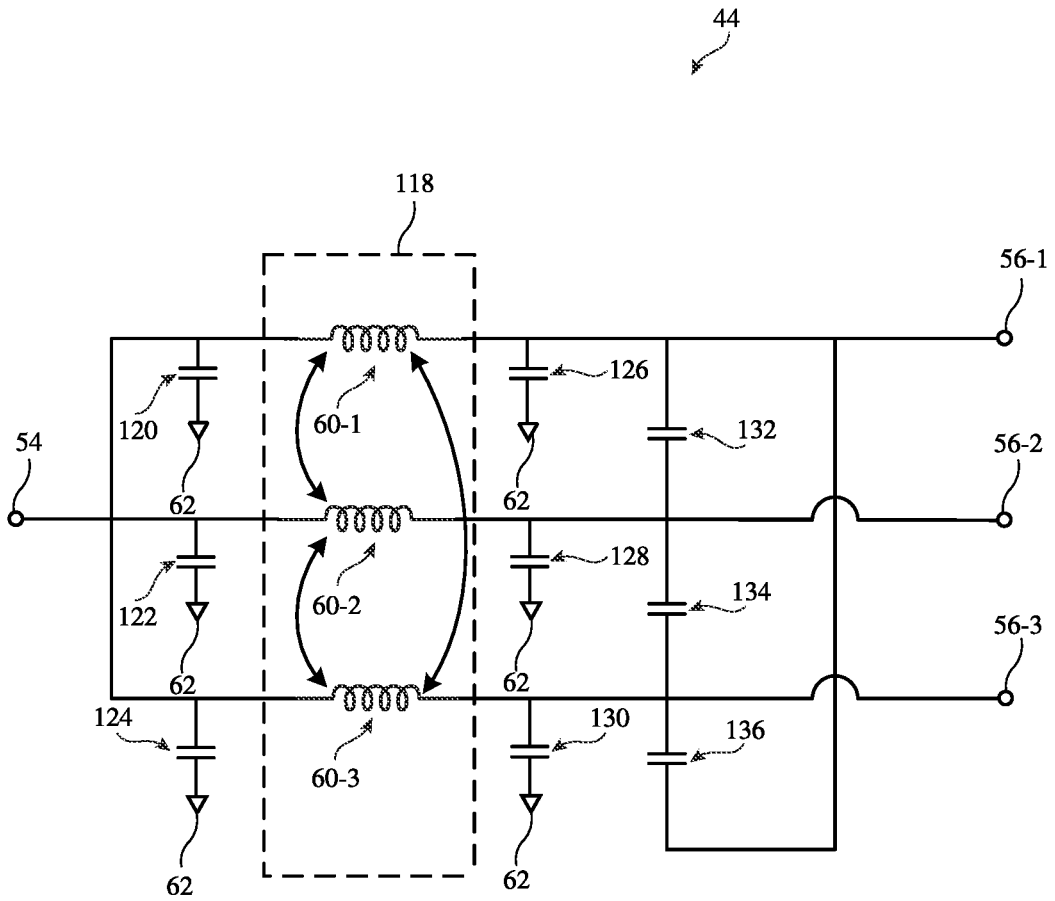
FIG. 6 is a circuit diagram of an illustrative 1:3 power splitter/combiner in accordance with some embodiments.

FIG. 6 is a circuit diagram of an exemplary 1:3 power splitter/combiner 44. As shown in FIG. 6, 1:3 power splitter/combiner 44 may have upstream port 54 and three downstream ports 56 such as downstream ports 56-1, 56-2, and 56-3. Upstream port 54 of FIG. 6 may be coupled to components in wireless circuitry 24 that are upstream from 1:3 power splitter/combiner 44. For example, upstream port 54 may be coupled to a downstream port on another 1:3 power splitter/combiner 44, may be coupled to a downstream port on a given 1:2 power splitter/combiner 46, may be coupled to a downstream port on a different power splitter/combiner in passive radio-frequency power distribution circuitry 34, may be coupled to upstream radio-frequency port 50 of FIG. 2, etc. Each downstream port 56 of FIG. 6 may be coupled to a respective component in wireless circuitry 24 that is downstream from 1:3 power splitter/combiner 44 (e.g., respective antennas 40 in phased antenna array 42, respective upstream ports of other power splitter/combiners, etc.).

In scenarios where 1:3 power splitter/combiner 44 is being used to transmit radio-frequency signals over antennas 40 (e.g., where 1:3 power splitter/combiner 44 is a 1:3 power splitter), upstream port 54 forms an input port and downstream ports 56 form output ports of 1:3 power splitter/combiner 44. In scenarios where 1:3 power splitter/combiner 44 is being used to receive radio-frequency signals from antennas 40 (e.g., where 1:3 power splitter/combiner 44 is a 1:3 power combiner), upstream port 54 forms an output port and downstream ports 56 form input ports of 1:3 power splitter/combiner 44.

1:3 power splitter/combiner 44 may include a transformer such as transformer 118. Transformer 118 may be coupled between upstream port 54 and downstream ports 56. Transformer 118 may include a set of inductors 60 coupled in parallel between upstream port 54 and downstream ports 56. For example, as shown in FIG. 6, transformer 118 may include a first inductor 60-1 coupled between upstream port 54 and downstream port 56-1, may include a second inductor 60-2 coupled between upstream port 54 and downstream port 56-2, and may include a third inductor 60-3 coupled between upstream port 54 and downstream port 56-3. In general, there may be as many inductors 60 as there are downstream ports 56 in the power splitter/combiners in passive radio-frequency power distribution circuitry 34.

1:3 power splitter/combiner 44 may include capacitors such as capacitors 120, 122, 124, 126, 128, 130, 132, 134, and 136. Capacitor 132 may be coupled between downstream ports 56-1 and 56-2. Capacitor 134 may be coupled between downstream ports 56-2 and 56-3. Capacitor 136 may be coupled between downstream ports 56-1 and 56-3. Capacitor 120 may be coupled between upstream port 54 and reference potential 62 at the upstream side of inductor 60-1. Capacitor 122 may be coupled between upstream port 54 and reference potential 62 at the upstream side of inductor 60-2. Capacitor 124 may be coupled between upstream port 54 and reference potential 62 at the upstream side of inductor 60-3. Capacitor 126 may be coupled between downstream port 56-1 and reference potential 62 at the downstream side of inductor 60-1. Capacitor 128 may be coupled between downstream port 56-2 and reference potential 62 at the downstream side of inductor 60-2. Capacitor 130 may be coupled between downstream port 56-3 and reference potential 62 at the downstream side of inductor 60-3.

In one embodiment that is described herein as an example, capacitors 120-136 are distributed capacitors that exhibit distributed capacitances between conductive traces in 1:3 power splitter/combiner 44. This is merely illustrative and, if desired, one or more of these capacitors may be discrete capacitors (e.g., surface mount technology (SMT) capacitors). Transformer 118 and capacitors 120-136 may serve to distribute radio-frequency power at upstream port 54 across downstream ports 56-1, 56-2, and 56-3 (e.g., in scenarios where 1:3 power splitter/combiner 44 is transmitting radio-frequency signals over antennas 40) and/or to combine radio-frequency power at downstream ports 56-1, 56-2, and 56-3 onto upstream port 54.

Figure 7:
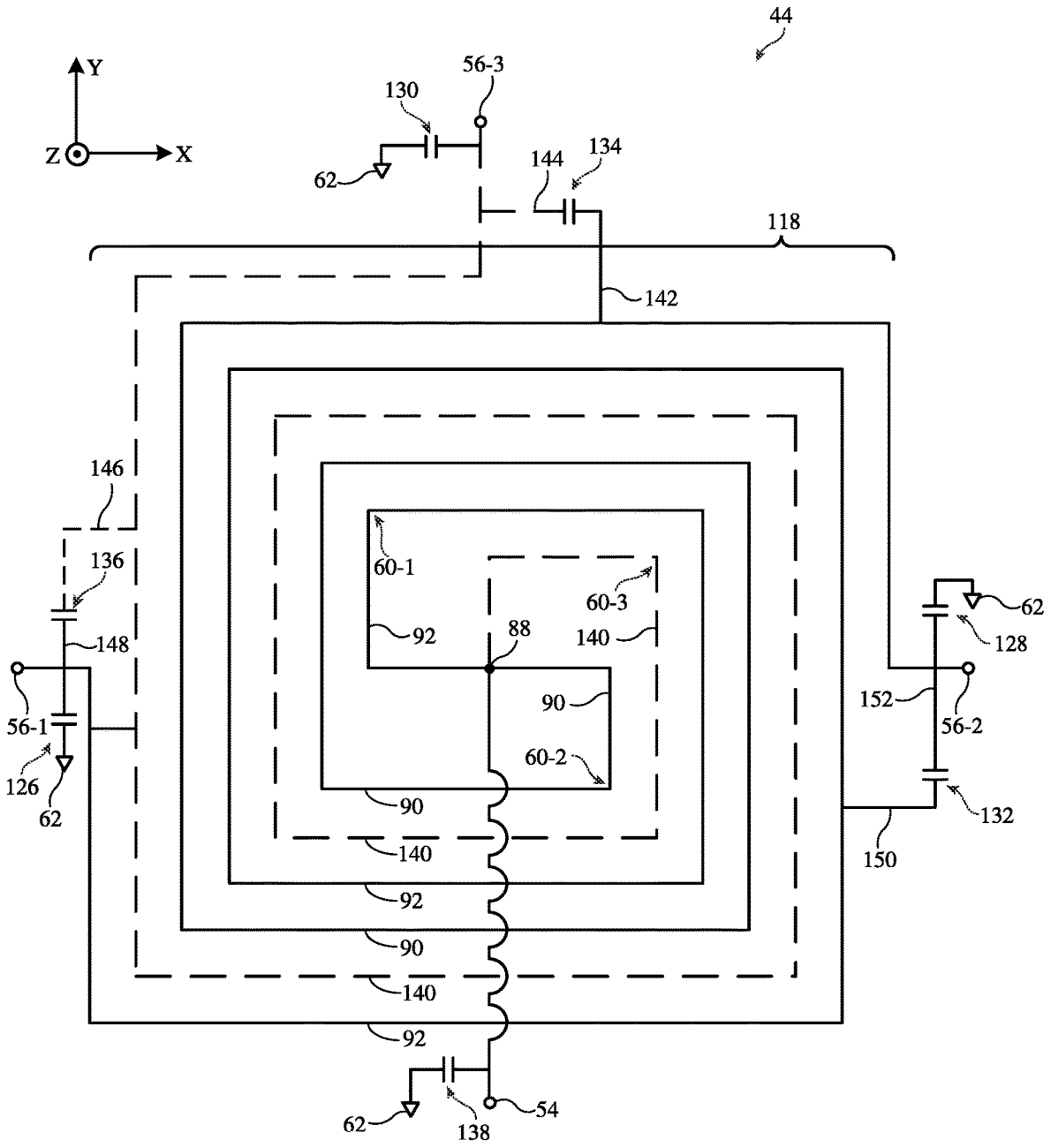
FIG. 7 is a diagram of an illustrative 1:3 power splitter/combiner having intertwined inductors in accordance with some embodiments.

In order to minimize the lateral footprint of transformer 118, inductors 60-1, 60-2, and 60-3 may be intertwined inductors (e.g., intertwined inductors that are concentric about a single point). FIG. 7 is a diagram showing how 1:3 power splitter/combiner 44 may include intertwined inductors 60-1, 60-2, and 60-3. As shown in FIG. 7, upstream port 54 may be coupled to transformer 118 at feed point 88 (e.g., using a conductive feed trace on an underlying dielectric substrate). A capacitance such as capacitance 138 may be coupled between upstream port 54 and reference potential 62. Capacitance 138 may, for example, be the capacitance associated with capacitors 120, 122, and 124 of FIG. 6.

Inductor 60-1 may be formed from conductive traces 92 and inductor 60-2 may be formed from conductive traces 90, similar to as described above in connection with FIG. 4. Inductor 60-3 in 1:3 power splitter/combiner 44 may be formed from conductive traces 140 (shown as dashed lines in FIG. 7). Conductive traces 140 and the feed trace for upstream port 54 may extend from opposing sides of feed point 88. Conductive traces 140 may have a planar spiral or coil shape and may wind (wrap) around feed point 88 in the same direction as conductive traces 90 and 92 (e.g., in a clockwise direction about feed point 88). Conductive traces 140 and thus inductor 60-3 may terminate at downstream port 56-3. Coiling conductive traces 140 in this way may configure conductive traces 140 to exhibit a desired inductance between feed point 88 and downstream port 56-3 (e.g., the inductance of inductor 60-3).

As shown in FIG. 7, when configured in this way, conductive traces 92 and thus inductor 60-1 may be intertwined with both conductive traces 90 (inductor 60-2) and conductive traces 140 (inductor 60-3). Each segment of conductive traces 92 except for the first and last quarter-turn around feed point 88 may be laterally interposed between a corresponding segment of conductive traces 90 and a corresponding segment of conductive traces 140. Similarly, each segment of conductive traces 90 except for the first and last quarter-turn around feed point 88 may be laterally interposed between a corresponding segment of conductive traces 92 and a corresponding segment of conductive traces 140. Each segment of conductive traces 140 except for the first and last quarter-turn around feed point 88 may be laterally interposed between a corresponding segment of conductive traces 92 and a corresponding segment of conductive traces 90.

In other words, conductive traces 92 (inductor 60-1), conductive traces 90 (inductor 60-2), and conductive traces 140 (inductor 60-3) may be arranged in a common centroid configuration in which the conductive traces and inductors are concentric about a common point or axis (e.g., feed point 88 or an axis running through feed point 88 parallel to the Z-axis of FIG. 7). This may configure transformer 118 to exhibit a lateral footprint similar to only a single one of inductors 60-1, 60-2, or 60-3 rather than a lateral footprint that is greater than or equal to the lateral footprint of inductors 60-1, 60-2, and 60-3 combined. This may serve to minimize the lateral footprint and thus the space consumed by transformer 118 in device 10.

In the example of FIG. 7, conductive traces 92, 90, and 140 (inductors 60-1, 60-2, and 60-3) each make two complete turns (e.g., 360-degree passes) around feed point 88 in winding from feed point 88 to downstream ports 56-1, 56-2, and 56-3, respectively. This is merely illustrative. In other embodiments, conductive traces 92, 90, and 140 may each make three complete turns around feed point 88, one complete turn around feed point 88, more than three complete turns around feed point 88, a non-integer number of turns around feed point 88, etc. If desired, conductive traces 92, 90, and/or 140 may each have the same shape (e.g., a rectangular spiral shape).

As shown in FIG. 7, capacitor 126 may be coupled between conductive traces 92 and reference potential 62 (e.g., at downstream port 56-1). Capacitor 128 may be coupled between conductive traces 90 and reference potential 62 (e.g., at downstream port 56-2). Capacitor 130 may be coupled between conductive traces 140 and reference potential 62 (e.g., at downstream port 56-3).

Conductive traces 92 may include segment 148. Conductive traces 140 may include segment 86. Segments 86 and 84 may form respective capacitor electrodes for capacitor 136. Conductive traces 92 may also include segment 150. Conductive traces 90 may include segment 152. Segments 150 and 152 may form respective capacitor electrodes for capacitor 132. Conductive traces 140 may include segment 144. Conductive traces 90 may include segment 142. Segments 142 and 144 may form respective capacitor electrodes for capacitor 134.

Figure 8:
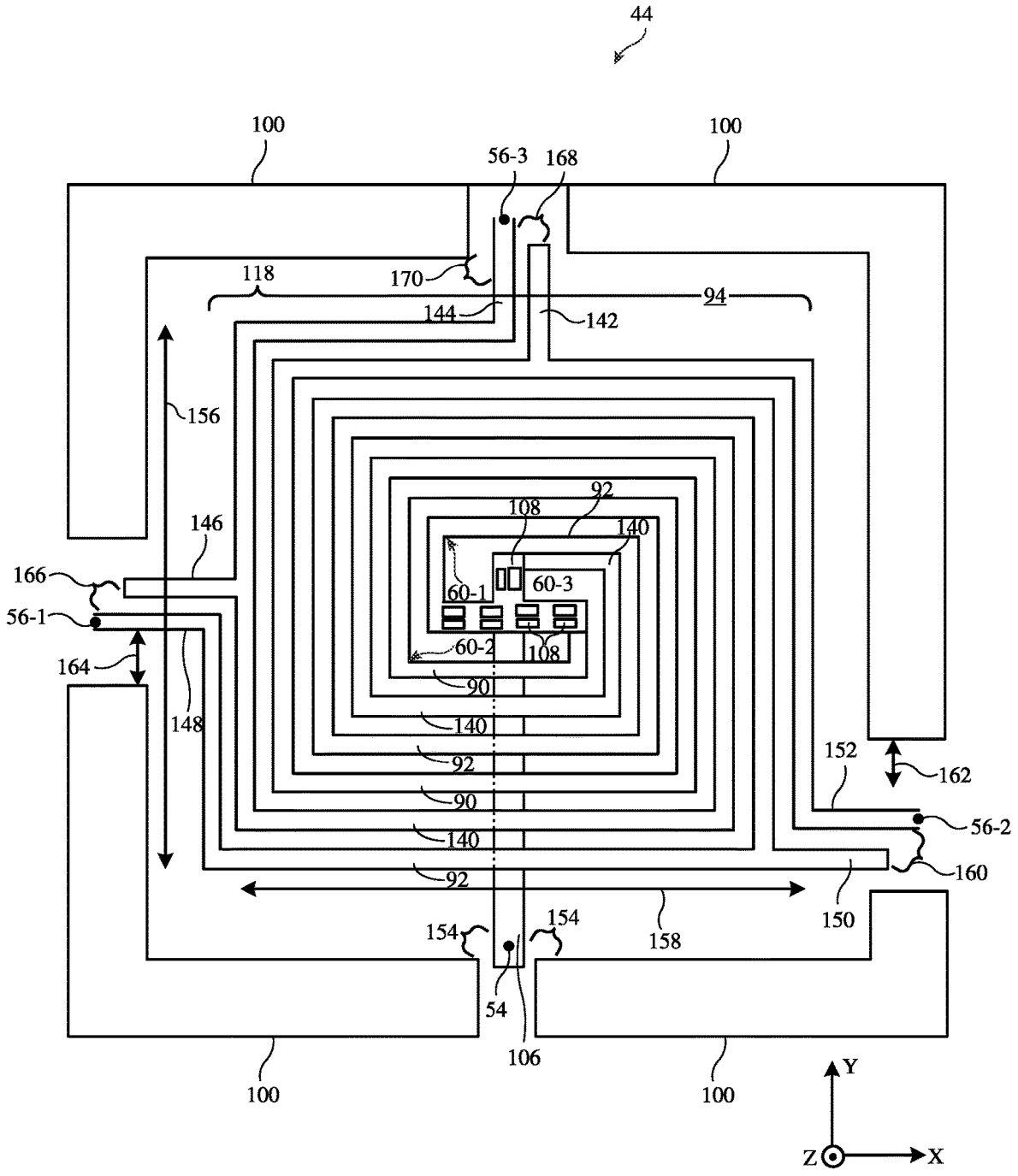
FIG. 8 is a layout diagram of an illustrative 1:3 power splitter/combiner having intertwined inductors in accordance with some embodiments.

FIG. 8 is a top-down layout diagram of 1:3 power splitter/combiner 44. As shown in FIG. 8, conductive traces 90 for inductor 60-2, conductive traces 92 for inductor 60-1, and conductive traces 140 for inductor 60-3 may be patterned onto dielectric substrate 94. One or more conductive through vias such as conductive vias 108 may couple feed trace 106 to conductive traces 92, 90, and 140 (e.g., at and/or adjacent feed point 88). Feed trace 106 may be laterally separated from ground traces 100 by one or more gaps 154. The capacitance associated with gap(s) 154 may form capacitance 138 of FIG. 7 and the capacitance of capacitors 120-124 of FIG. 6, for example.

Conductive traces 92, 90, and 140 may intertwined as the conductive traces spiral from feed point 88 outwards to downstream ports 56-1, 56-2, and 56-3 (e.g., conductive traces 92, 90, and 140 may be interspersed or interleaved as the conductive traces wind around feed point 88). This may configure inductors 60-1, 60-2, and 60-3 and thus transformer 58 to exhibit a length 158 and a width 156. Length 158 and width 156 may define the lateral footprint of transformer 118. Length 158 may be equal to width 156 or may be different from width 156. As just one example, width 156 may be between 40-90 microns whereas length 158 is between 50-100 microns. The lateral footprint of transformer 118 may be similar to the lateral footprint of just one of inductors 60-1, 60-2, or 60-3, thereby minimizing the overall footprint of 1:3 power splitter/combiner 44, despite the fact that 1:3 power splitter/combiner 44 includes three separate inductors that are coupled in parallel between upstream port 54 and downstream ports 56-1, 56-2, and 56-3.

As shown in FIG. 8, at downstream port 56-1, segment 148 of conductive traces 92 may be separated from ground traces 100 by gap 164. At downstream port 56-2, segment 152 of conductive traces 90 may be separated from ground traces 100 by gap 162. At downstream port 56-3, segment 144 of conductive traces 140 may be separated from ground traces 100 by gap 170. The capacitance associated with gap 164 may form capacitor 126 of FIGS. 6 and 7, for example. Similarly, the capacitance associated with gap 162 may form capacitor 128 and the capacitance associated with gap 170 may form capacitor 130 of FIGS. 6 and 7.

Segment 152 of conductive traces 90 may extend parallel to segment 150 of conductive traces 92. Segment 152 may be separated from segment 150 by gap 160. Segment 144 of conductive traces 140 may extend parallel to segment 142 of conductive traces 90. Segment 144 may be separated from segment 142 by gap 168. Segment 148 of conductive traces 92 may extend parallel to segment 146 of conductive traces 140. Segment 148 may be separated from segment 146 by gap 166. The capacitance associated with gap 166 may form capacitor 136, the capacitance associated with gap 168 may form capacitor 134, and the capacitance associated with gap 160 may form capacitor 132 of FIG. 6, for example.

The example of FIG. 8 is merely illustrative. Conductive traces 90, 92, and 140 may have other shapes concentric about feed point 88 if desired (e.g., conductive traces 90, 92, and 140 may have a rectangular spiral shape, circular spiral shape, elliptical spiral shape, combinations of these, shapes with any desired number of straight and/or curved segments, etc.). The structures of 1:2 power splitter/combiner 46 and 1:3 power splitter/combiner 44 may be scaled to provide passive radio-frequency power distribution circuitry 34 with power splitter/combiners of any desired size (e.g., 1:4 power splitter/combiners, 1:5 power splitter/combiners, 1:6 power splitter/combiners, etc.).

1:2 power splitter/combiner 46 and 1:3 power splitter/combiner 44 may still exhibit satisfactory radio-frequency performance despite the superposition of inductors 60-1, 60-2, and 60-3 within the same lateral footprint on dielectric substrate 94. The power splitter/combiner may, for example, exhibit satisfactory impedance matching at each upstream port and each downstream port in the frequency bands handled by antennas 40. The power splitter/combiner may also exhibit sufficiently low insertion loss and a satisfactory phase response between each combination of the upstream/downstream ports in the frequency bands handled by antennas 40. In addition, the power splitter/combiner may exhibit satisfactory radio-frequency isolation between each of the upstream/downstream ports.

The foregoing is merely illustrative and various modifications can be made to the described embodiments. The foregoing embodiments may be implemented individually or in any combination.

What is claimed is:

1. Wireless circuitry comprising:

a substrate; and a transformer having a first inductor and a second inductor, wherein the first inductor is coupled between a first port and a second port, the second inductor is coupled between the first port and a third port, and the second inductor is intertwined with the first inductor on the substrate.

2. The wireless circuitry of claim 1, wherein the first inductor includes first conductive traces on the substrate, the second inductor includes second conductive traces on the substrate, the first and second conductive traces extend from opposing sides of a point, the first conductive traces extend from the point to the second port, and the second conductive traces extend from the point to the third port.

3. The wireless circuitry of claim 2, wherein the first conductive traces wind at least once around the point and the second conductive traces wind at least once around the point.

4. The wireless circuitry of claim 3, wherein the substrate has a first layer and a second layer stacked onto the first layer, the first and second conductive traces are patterned on the second layer, and the wireless circuitry further comprises a third conductive trace on the first layer and coupled to the first port.

5. The wireless circuitry of claim 4, further comprising:

a conductive via that extends through the first layer and that couples the third conductive trace to the point.

6. The wireless circuitry of claim 3, further comprising:

a first antenna coupled to the second port; and a second antenna coupled to the third port.

7. The wireless circuitry of claim 6, further comprising:

a third antenna, wherein the transformer couples the first port to a fourth port and the fourth port is coupled to the third antenna.

8. The wireless circuitry of claim 7, the transformer further comprising:

a third inductor coupled between the first and fourth ports, wherein the third inductor is intertwined with the first and second inductors on the substrate, the third inductor includes third conductive traces on the substrate, the third conductive traces extend from the point to the third port, and the third conductive traces wind at least once around the point.

9. The wireless circuitry of claim 8, further comprising:

a first capacitor coupled between the second and third ports;

a second capacitor coupled between the third and fourth ports; and a third capacitor coupled between the second and fourth ports.

10. The wireless circuitry of claim 9, wherein the first conductive traces include a first and second segments, the second conductive traces include third and fourth segments, the third conductive traces include fifth and sixth segments, the first capacitor has opposing capacitor electrodes formed from the first and third segments, the second capacitor has opposing capacitor electrodes formed from the second and fifth segments, and the third capacitor has opposing capacitor electrodes formed from the fourth and sixth segments.

11. The wireless circuitry of claim 8, wherein the first, second, and third conductive traces wind at least twice in a common direction about the point.

12. The wireless circuitry of claim 6, further comprising:

a first phase and magnitude controller coupled between the second port and the first antenna;

a second phase and magnitude controller coupled between the third port and the second antenna; and a phased antenna array that includes the first and second antennas and that is configured to convey radio-frequency signals at a frequency greater than 20 GHz.

13. A power splitter configured to distribute power from a first port onto second and third ports, comprising:

a substrate;

first conductive traces on the substrate, the first conductive traces extending from a point to the second port and winding at least once around the point; and second conductive traces on the substrate, the second conductive traces extending from the point to the third port and winding at least once around the point, the point being coupled to the first port.

14. The power splitter of claim 13, wherein the first and second conductive traces are intertwined on the substrate and concentric about the point.

15. The power splitter of claim 13, further comprising:

a fourth port, the power splitter being configured to distribute the power from the first port onto the fourth port; and third conductive traces on the substrate, the third conductive traces extending from the point to the fourth port and winding at least once around the point.

16. The power splitter of claim 15, wherein the first, second, and third conductive traces are coupled in parallel between the point and the second, third, and fourth ports, respectively.

17. A power combiner configured to combine power from first and second ports onto a third port, comprising:

a substrate;

first conductive traces on the substrate, the first conductive traces extending from the first port to a point and winding at least once around the point; and second conductive traces on the substrate, the second conductive traces extending from the second port to the point and winding at least once around the point, the point being coupled to the third port.

18. The power combiner of claim 17, wherein the first and second conductive traces are intertwined on the substrate and concentric about the point.

19. The power combiner of claim 17, further comprising:

a fourth port, the power combiner being configured to distribute the power from the fourth port onto the third port; and third conductive traces on the substrate, the third conductive traces extending from the fourth port to the point and winding at least once around the point.

20. The power combiner of claim 19, wherein the first, second, and third conductive traces are coupled in parallel between the point and the first, second, and fourth ports, respectively.

* * * * *